US012606893B2

(12) United States Patent
Pipard et al.

(10) Patent No.: US 12,606,893 B2
(45) Date of Patent: Apr. 21, 2026

(54) COLD ROLLED AND HEAT TREATED STEEL SHEET AND A METHOD OF MANUFACTURING THEREOF

(71) Applicant: ArcelorMittal, Luxembourg (LU)

(72) Inventors: Jean-Marc Pipard, Vaux (FR); Artem Arlazarov, Moulins les Metz (FR)

(73) Assignee: ArcelorMittal, Luxembourg (LU)

( * ) Notice: Subject to any disclaimer, the term of this patent is extended or adjusted under 35 U.S.C. 154(b) by 166 days.

(21) Appl. No.: 18/265,288

(22) PCT Filed: Dec. 8, 2020

(86) PCT No.: PCT/IB2020/061639

§ 371 (c)(1),
(2) Date: Jun. 5, 2023

(87) PCT Pub. No.: WO2022/123289

PCT Pub. Date: Jun. 16, 2022

(65) Prior Publication Data

US 2024/0035133 A1 Feb. 1, 2024

(51) Int. Cl.

| | |
|---|---|
| ***C21D 9/46*** | (2006.01) |
| ***C21D 6/00*** | (2006.01) |
| ***C21D 8/02*** | (2006.01) |
| ***C21D 8/0221*** | (2026.01) |
| ***C21D 8/0247*** | (2026.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/26*** | (2006.01) |
| ***C22C 38/34*** | (2006.01) |
| ***C22C 38/38*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |
| ***C22C 38/58*** | (2006.01) |

(52) U.S. Cl.

CPC ..... *C22C 38/38* (2013.01); *C21D 6/00* (2013.01); *C21D 6/002* (2013.01); *C21D 6/005* (2013.01); *C21D 6/008* (2013.01); *C21D 8/02* (2013.01); *C21D 8/0226* (2013.01); *C21D 8/0236* (2013.01); *C21D 8/0273* (2013.01); *C21D 9/46* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/26* (2013.01); *C22C 38/34* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C22C 38/58* (2013.01); *C21D 2211/001* (2013.01); *C21D 2211/002* (2013.01); *C21D 2211/005* (2013.01); *C21D 2211/008* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 10,995,386 | B2 * | 5/2021 | Arlazarov | C22C 38/58 |
| 11,365,468 | B2 * | 6/2022 | Pipard | C22C 38/38 |
| 11,572,599 | B2 * | 2/2023 | Pipard | C22C 38/001 |
| 2014/0000765 | A1 | 1/2014 | Nozaki et al. | |
| 2015/0152533 | A1 | 6/2015 | Bongards et al. | |
| 2017/0101695 | A1 * | 4/2017 | Arlazarov | C23C 2/0224 |
| 2017/0107591 | A1 | 4/2017 | Takashima et al. | |

(Continued)

FOREIGN PATENT DOCUMENTS

| | | | |
|---|---|---|---|
| CN | 104583424 | A | 4/2015 |
| EP | 3009527 | A1 | 4/2016 |

(Continued)

OTHER PUBLICATIONS

Search Report of PCT/IB2020/061639 of Sep. 8, 2021 and International Report on Patentability.

(Continued)

*Primary Examiner* — Jophy S. Koshy

(74) *Attorney, Agent, or Firm* — Davidson Kappel LLC

(57) ABSTRACT

A cold rolled and heat treated steel sheet having a composition including the following elements: 0.1%≤Carbon≤0.5%, 1%≤Maganeses≤3.4%, 0.5%≤Silicon≤2.5%, 0.01%≤Aluminum≤1.5%, 0.05%≤Chromium≤1%, 0.001%≤Niobium≤0.1%, 0%≤Sulfur≤0.003%, 0.002%≤Phosphorus≤0.02%, 0%≤Nitrogen≤0.01%, 0%≤Molybdenum≤0.5%, 0.001%≤Titanium≤0.1%, 0.01%≤Coppers≤2%, 0.01%≤Nickel≤3%, 0.0001%≤Calcium≤0.005%, 0%≤Vanadium≤0.1%, 0%≤Boron≤0.003%, 0%≤Ceriurm≤0.1%, 0%≤Magnesium≤0.010%, 0%≤Zirconium≤0.010% the remainder composition being composed of iron and the unavoidable impurities, and a microstructure of the rolled steel sheet includes by area fraction, 10% to 60% Bainite, 5% to 50% Ferrite, 5% to 25% Residual Austenite, Martensite 2% to 20%, Tempered Martensite 0% to 25%, the balance being Annealed Martensite, which content shall be from 1% to 45%.

11 Claims, No Drawings

(56) References Cited

U.S. PATENT DOCUMENTS

| | | | |
|---|---|---|---|
| 2018/0002771 | A1 | 1/2018 | Han et al. |
| 2019/0003008 | A1 | 1/2019 | Gospodinova et al. |
| 2020/0095657 | A1 | 3/2020 | Pipard et al. |
| 2021/0040576 | A1 | 2/2021 | Uta et al. |

FOREIGN PATENT DOCUMENTS

| | | | |
|---|---|---|---|
| EP | 3144406 | A1 | 3/2017 |
| JP | 5896086 | | 3/2016 |
| JP | 2019506530 | A | 3/2019 |
| KR | 20130036752 | A | 4/2013 |
| WO | WO2012133563 | A1 | 10/2012 |
| WO | WO2019092576 | A1 | 5/2019 |
| WO | WO2019092577 | A1 | 5/2019 |
| WO | WO2019092578 | A1 | 5/2019 |
| WO | WO2020169410 | A1 | 8/2020 |

OTHER PUBLICATIONS

Van Bohemen, S., Sietsma, J. Martensite Formation in Partially and Fully Austenitic Plain. Carbon Steels. *Metall Mater Trans A* 40, 1059-1068 (2009). https://doi.org/10.1007/s11661-009-9796-2.

* cited by examiner

COLD ROLLED AND HEAT TREATED STEEL SHEET AND A METHOD OF MANUFACTURING THEREOF

The present invention relates to cold rolled and heat treated steel sheet which is suitable for use as a steel sheets for automobiles.

BACKGROUND

Automotive parts are required to satisfy two inconsistent necessities, e.g. ease of forming and strength, but in recent years a third requirement of improvement in fuel consumption is also bestowed upon automobiles in view of global environment concerns. Thus, now automotive parts must be made of material having high formability in order to fit in the criteria of ease of fit in the intricate automobile assembly and at same time improve strength for vehicle crashworthiness and durability while reducing the weight of vehicle to improve fuel efficiency.

Therefore, intense Research and development endeavors have been undertaken to reduce the amount of material utilized in car by increasing the strength of material. Conversely, an increase in strength of steel sheets decreases formability, and thus development of materials having both high strength and high formability is necessitated.

Earlier research and developments in the field of high strength and high formability steel sheets have resulted in several methods for producing high strength and high formability steel sheets, some of which are enumerated herein for appreciation of the present invention:

EP3144406 a patent that claims a high-strength cold roiled steel sheet having excellent ductility comprises by wt. %, Carbon (C): 0.1% to 0.3%, Silicon (Si): 0.1% to 2.0%, Aluminum (Al): 0.005% to 1.5 Manganese (Mn): 1.5% to 3.0%, Phosphorus (P): 0.04% or less (excluding 0%), Sulfur (S): 0.015% or less (excluding 0%), Nitrogen (N): 0.02% or less (excluding 0%), and a remainder of iron (Fe) and inevitable impurities wherein a sum of Silicon and Aluminum (Si+Al) (wt %) satisfies 1.0% or more, and wherein a microstructure comprises: by area fraction, 5% or less of polygonal ferrite having a minor axis to major axis ratio of 0.4 or greater, 70% or less (excluding 0%) of Acicular Ferrite having a minor axis to major axis ration pf 0.4 or less, 25% or less (excluding 0%) of acicular Retained Austenite, and a remainder of Martensite. Further EP3144406 envisages for a high strength steel with a tensile strength of 780 MPa or more.

EP3009527 provides a high-strength cold-rolled steel sheet having excellent elongation, excellent stretch flangeability, and high yield ratio and a method for manufacturing the same. The high-strength cold-rolled steel sheet has a composition and a microstructure. The composition contains 0.15% to 0.27% C, 0.8% to 2.4% Si, 2.3% to 3.5% Mn, 0.08% or less P, 0.005% or less S, 0.01% to 0.08% Al, and 0.010% or less N on a mass basis, the remainder being Fe and inevitable impurities. The microstructure comprises: ferrite having an average grain size of 5 μm or less and a volume fraction of 3% to 20%, retained austenite having a volume fraction of 5% to 20%, and martensite having a volume fraction of 5% to 20%, the remainder being bainite and/or tempered martensite. The total number of retained austenite with a grain size of 2 μm or less, martensite with a grain size of 2 μm or less, or a mixed phase thereof is 150 or more per 2,000 μm 2 of a thickness cross section parallel to the rolling direction of the steel sheet. The steel sheet of EP3009527 is able to reach the strength of 960 MPA or more but unable to achieve the elongation of 20% or more.

SUMMARY OF THE INVENTION

An object of the present invention is to solve these problems by making available cold-rolled heat treated steel sheets that simultaneously have:

- an ultimate tensile strength greater than or equal to 960 MPa and preferably above 980 MPa,
- a total elongation greater than or equal to 20% and preferably above 21%

In a preferred embodiment, the steel sheet according to the invention has a yield strength greater than or equal to 475 MPa In a preferred embodiment, the steel sheet according to the invention has a yield strength/tensile strength ratio of 0.45 or greater.

Preferably, such steel can also have a good suitability for forming, in particular for rolling with good weldability and coatability.

Another object of the present invention is also to make available a method for the manufacturing of these sheets that is compatible with conventional industrial applications while being robust towards manufacturing parameters shifts.

The cold rolled heat treated steel sheet of the present invention may optionally be coated with zinc or zinc alloys, or with aluminum or aluminum alloys to improve its corrosion resistance.

DETAILED DESCRIPTION

Carbon is present in the steel from 0.1% to 0.5%. Carbon is an element necessary for increasing the strength of the Steel of the present invention by producing a low-temperature transformation phases such as Martensite. Carbon also plays a pivotal role in Austenite stabilization, hence, it is a necessary element for securing Residual Austenite. Therefore, Carbon plays two pivotal roles, one is to increase the strength and another in Retaining Austenite to impart ductility. But Carbon content less than 0.1% will not be able to stabilize Austenite in an adequate amount required by the steel of the present invention. On the other hand, at a Carbon content exceeding 0.5%, the steel exhibits poor spot weldability, which limits its application for the automotive parts. Preferable limit for carbon is from 0.15% to 0.45% and more preferred limit is from 0.15% to 0.3%.

Manganese content of the steel of present invention is from 1% to 3.4%. This element is gammagenous. The purpose of adding Manganese is essentially to obtain a structure that contains Austenite. Manganese is an element which stabilizes Austenite at room temperature to obtain Residual Austenite. An amount of at least about 1% by weight of Manganese is mandatory to provide the strength and hardenability to the Steel of the present invention as well as to stabilize Austenite. Thus, a higher percentage of Manganese is preferred by the present invention such as 3%. But when Manganese content is more than 3.4% it produces adverse effects such as it retards transformation of Austenite to Bainite during the isothermal holding for Bainite transformation. In addition Manganese content of above 3.4% also deteriorates the weldability of the present steel as well as the ductility targets may not be achieved. The preferable range for Manganese is 1.2% and 2.8% and more preferable range is between 1.3% and 2.4%.

Silicon content of the Steel of the present invention is from 0.5% to 2.5%. Silicon is a constituent that can retard the precipitation of carbides during overageing, therefore, due to the presence of Silicon, Carbon rich Austenite is stabilized at room temperature. Further due to poor solubility of Silicon in carbide it effectively inhibits or retards the formation of carbides, hence, also promotes the formation of low density carbides in Bainitic structure which is sought as per the present invention to impart the Steel of the present invention with its essential mechanical properties. However, disproportionate content of Silicon does not produce the mentioned effect and leads to problems such as temper embrittlement. Therefore, the concentration is controlled within an upper limit of 2.5%. Preferable limit for Silicon is from 0.8% to 2% and more preferred limit is from 1.3% to 1.9%.

The content of the Aluminum is from 0.01% to 1.5%. In the present invention Aluminum removes Oxygen existing in molten steel to prevent Oxygen from forming a gas phase during solidification process. Aluminum also fixes Nitrogen in the steel to form Aluminum nitride so as to reduce the size of the grains. Higher content of Aluminum, above 1.5%, increases Ac3 point to a high temperature thereby lowering the productivity. Preferable limit for Aluminum is from 0.01% to 1% and more preferred limit is from 0.01% to 0.5%.

Chromium content of the Steel of the present invention is from 0.05% to 1%. Chromium is an essential element that provides strength and hardening to the steel but when used above 1% impairs surface finish of steel. Further Chromium content under 1% coarsens the dispersion pattern of carbide in Bainitic structures, hence, keeps the density of Carbide low in Bainite. Preferable limit for Chromium is from 0.1% to 0.8% and more preferred limit is from 0.2% to 0.6%.

Niobium is present in the Steel of the present invention from 0.001% to 0.1% and suitable for forming carbo-nitrides to impart strength of the Steel of present invention by precipitation hardening. Niobium will also impact the size of microstructural components through its precipitation as carbo-nitrides and by retarding the recrystallization during heating process. Thus finer microstructure formed at the end of the holding temperature and as a consequence after the complete annealing will lead to the hardening of the product. However, Niobium content above 0.1% is not economically interesting as a saturation effect of its influence is observed. This means that additional amount of Niobium does not result in any strength improvement of the product. Preferable limit for niobium is from 0.001% to 0.09% and more preferred limit is from 0.001% to 0.07%.

Sulfur is not an essential element but may be contained as an impurity in steel and from point of view of the present invention the Sulfur content is preferably as low as possible, but is 0.003% or less from the viewpoint of manufacturing cost. Further if higher Sulfur is present in steel it combines to form Sulfides especially with Manganese and reduces its beneficial impact on the present invention.

Phosphorus constituent of the Steel of the present invention is between 0.002% and 0.02%, Phosphorus reduces the spot weldability and the hot ductility, particularly due to its tendency to segregate at the grain boundaries or co-segregate with Manganese. For these reasons, its content is limited to 0.02% and preferably lower than 0.013%.

Nitrogen is limited to 0.01% in order to avoid ageing of material and to minimize the precipitation of Aluminum nitrides during solidification which are detrimental for mechanical properties of the steel. Molybdenum is an optional element that constitutes 0% to 0.5% of the Steel of the present invention; Molybdenum plays an effective role in improving hardenability and hardness, delays the appearance of Bainite and avoids carbides precipitation in Bainite. However, the addition of Molybdenum excessively increases the cost of the addition of alloy elements, so that for economic reasons its content is limited to 0.5%.

Titanium is an optional element that can be added to the Steel of the present invention from 0.001% to 0.1%. As with Niobium, it is involved in carbo-nitrides so plays a role in hardening. But it is also forms Titanium-nitrides appearing during solidification of the cast product. The amount of Titanium is so limited to 0.1% to avoid the formation of coarse Titanium-nitrides detrimental for formability. Titanium content below 0.001% does not impart any effect on the steel of present invention. Preferable limit for titanium is from 0.001% to 0.09% and more preferred limit is from 0.001% to 0.07%.

Copper may be added as an optional element in an amount of 0.01% to 2% to increase the strength of the Steel and to improve its corrosion resistance. A minimum of 0.01% is required to get such effects. However, when its content is above 2%, it can degrade the surface aspects.

Nickel may be added as an optional element in an amount of 0.01% to 3% to increase the strength of the Steel and to improve its toughness. A minimum of 0.01% is required to get such effects. However, when its content is above 3%, Nickel causes ductility deterioration.

Calcium content is an optional element that can be added in the steel of the present invention from 0.0001% to 0.005%. Calcium is added to steel of the present invention as an optional element especially during the inclusion treatment. Calcium contributes towards the refining of the Steel by arresting the detrimental Sulfur content in globular form thereby retarding the harmful effect of Sulfur.

Vanadium is an optional element that can be added as it is effective in enhancing the strength of steel by forming carbides or carbo-nitrides and the upper limit is 0.1% from economic points of view.

Other elements such as Cerium, Boron, Magnesium or Zirconium can be added individually or in combination in the following proportions: Cerium ≤0.1%, Boron ≤0.003%, Magnesium ≤0.010% and Zirconium ≤0.010%. Up to the maximum content levels indicated, these elements make it possible to refine the gain during solidification. The remainder of the composition of the steel consists of iron and inevitable impurities resulting from processing.

The microstructure of the steel sheet according to the invention comprises 10% to 50% of Bainite, 5% to 50% of Ferrite, 5% to 25% of Residual Austenite, 2% to 20% of Martensite, 0% to 25% of Tempered Martensite and 1% to 45% of presence of Annealed Martensite by area fraction.

The surface fractions of phases in the microstructure are determined through the following method: a specimen is cut from the steel sheet, polished and etched with a reagent known per se, to reveal the microstructure. The section is afterwards examined through scanning electron microscope, for example with a Scanning Electron Microscope with a Field Emission Gun ("FEG-SEM") at a magnification greater than 5000×, in secondary electron mode.

The determination of the fraction of ferrite is performed thanks to SEM observations after Nital or Picral/Nital reagent etching.

The determination of Residual Austenite is done by XRD and for the tempered martensite the dilatometry studies were conducted according the publication of S. M. C. Van Bohemen and J. Sietsma in Metallurgical and materials transactions, volume 40 Å, May 2009-1059.

Bainite constitutes between 10% and 60% of microstructure by area fraction for the Steel of the present invention.

To ensure a total elongation of 20% it is mandatory to have 10% of Bainite. Preferably presence of bainite is between 12% and 55% and more preferably between 13% and 52%.

Ferrite constitutes from 5% to 50% of microstructure by area fraction for the Steel of the present invention. Ferrite imparts elongation to the steel of the present invention. Ferrite of the present steel may comprise polygonal ferrite, lath ferrite, acicular ferrite, plate ferrite or epitaxial ferrite. To ensure an elongation of 20% or more it is necessary to have 5% of Ferrite. Ferrite of the present invention is formed during annealing and cooling done after annealing. But whenever ferrite content is present above 50% in steel of present invention it is not possible to have both yield strength and the total elongation at same time due to the fact that ferrite decreases the strength both tensile and yield strength and also increases the gap in hardness with hard phases such as martensite and bainite and reduces local formability. The preferred limit for presence of ferrite for the present invention is from 6% to 49%.

Residual Austenite constitutes 5% to 25% by area fraction of the Steel. Residual Austenite is known to have a higher solubility of Carbon than Bainite and hence acts as effective Carbon trap therefore retarding the formation of carbides in Bainite. Carbon percentage inside the Residual Austenite of present invention is preferably higher than 0.9%, and preferably lower than 1.2%, Residual Austenite of the steel according to the invention imparts an enhanced ductility. The preferred limit for residual austenite is between 8% to 24% and more preferably between 12% to 20%.

Martensite constitutes 2% to 20% by area fraction of the Steel. Martensite imparts the steel of the present invention with the tensile strength. Martensite is formed during the cooling after cooling after overaging. The preferred limit for martensite is from 3% to 18% and more preferably from 4% to 15%.

Tempered Martensite constitutes 0% to 25% of microstructure by area fraction. Martensite can be formed when steel is cooled between $Tc_{min}$ and $Tc_{max}$ and is tempered during the overaging holding. Tempered Martensite imparts ductility and strength to the present invention. When Tempered Martensite is in excess of 25% it imparts excess strength but diminishes the elongation beyond acceptable limit. The preferred limit of tempered martensite is from 0% to 20% and more preferably from 0% to 18%.

Annealed Martensite constitutes 1% to 45% of the microstructure of the steel of the present invention by area fraction. Annealed martensite imparts strength and formability to the Steel of the present invention. Annealed Martensite is formed during the second annealing at a temperature between TS and Ac3. It is necessary to have at least 1% of these microstructural constituents to reach the targeted elongation by the steel of present invention but when the amount of surpasses 45% the steel of present invention is unable to reach the strength and elongation simultaneously. The preferred limit for the presence is from 2% to 40% and more preferably from 2% to 35%.

In addition to the above-mentioned microstructure, the microstructure of the cold rolled and heat treated steel sheet is free from microstructural components, such as pearlite without impairing the mechanical properties of the steel sheets.

A steel sheet according to the invention can be produced by any suitable method. A preferred method consists in providing a semi-finished casting of steel with a chemical composition according to the invention. The casting can be done either into ingots or continuously in form of thin slabs or thin strips, i.e. with a thickness ranging from approximately 220 mm for slabs up to several tens of millimeters for thin strip.

For example, a slab having the above-described chemical composition is manufactured by continuous casting wherein the slab optionally underwent the direct soft reduction during the continuous casting process to avoid central segregation and to ensure a ratio of local Carbon to nominal Carbon kept below 1.10. The slab provided by continuous casting process can be used directly at a high temperature after the continuous casting or may be first cooled to room temperature and then reheated for hot rolling. The reheating temperature is between 1100° C. and 1280° C.

The temperature of the slab which is subjected to hot rolling is preferably at least 1200° C. and must be below 1280° C. In case the temperature of the slab is lower than 1200° C., excessive load is imposed on a rolling mill, and further, the temperature of the steel may decrease to a Ferrite transformation temperature during finishing rolling, whereby the steel will be rolled in a state in which transformed Ferrite contained in the structure. Therefore, the temperature of the slab is also preferably sufficiently high so that hot rolling can be completed in the temperature range of Ac3 to Ac3+200° C. and final rolling temperature remains above Ac3. Reheating at temperatures above 1280° C. must be avoided because they are industrially expensive.

A final rolling temperature range between Ac3 to Ac3+200° C. is preferred to have a structure that is favorable to recrystallization and rolling. It is necessary to have final rolling pass to be performed at a temperature greater than Ac3, because below this temperature the steel sheet exhibits a significant drop in rollability. The sheet obtained in this manner is then cooled at an average cooling rate above 30° C./s to the coiling temperature which must be below 600° C. Preferably, the cooling rate will be less than or equal to 200° C./s and the coiling temperature is preferably below 570° C.

The hot rolled steel sheet is coiled at a coiling temperature below 600° C. to avoid the ovalization of the hot rolled steel sheet and preferably below 570° C. to avoid scale formation. The preferable range of coiling temperature is between 350° C. and 570° C. The coiled hot rolled steel sheet is cooled to room temperature before subjecting it to optional Hot band annealing.

The hot rolled steel sheet may be subjected to an optional scale removal step to remove the scale formed during the hot rolling. The hot rolled sheet may then subjected to optional Hot Band Annealing at temperatures between 400° C. and 750° C. for at least 12 hours and not more than 96 hours but the temperature shall be kept below 750° C. to avoid transforming partially the hot-rolled microstructure and, therefore, to losing the microstructure homogeneity. Thereafter, an optional scale removal step may be performed to remove the scale for example through pickling such steel sheet. This hot rolled steel sheet is cold rolled with a thickness reduction between 35 to 90%. The cold rolled steel sheet obtained from cold rolling process is then subjected to two annealing cycles to impart the steel of the present invention with microstructure and mechanical properties.

In first annealing of the cold rolled steel sheet, the cold rolled steel sheet is heated at a heating rate HR1 which is greater than 3° C./s and preferably greater than 5° C./s, to a soaking temperature TS1 between TS and Ac3 wherein Ac3 and TS for the present steel is calculated by using the following formula:

$$TS=830-260*C-25*Mn+22*Si+40*Al$$

$$Ac3=901-262*C-29*Mn+31*Si-12*Cr-155*Nb+86*Al$$

wherein the elements contents are expressed in weight percentage.

The steel sheet is held at TS1 during 10 seconds to 500 seconds to ensure adequate recrystallization and at least 50% transformation to Austenite of the strongly work hardened initial structure. The sheet is then cooled at a cooling rate CR1 which is greater than 25° C./s and preferably greater than 50° C./s to room temperature. During this cooling the cold rolled steel sheet can be optionally held at a temperature range between 350° C. and 480° C. and preferable to a range between 380° C. to 450° C. and holding the holding time is from 10 seconds to 500 seconds, then the cold rolled steel sheet is cooled to room temperature to obtain annealed cold rolled steel sheet.

Then for the second annealing of the cold rolled and annealed steel sheet is heated at a heating rate HR2 which is greater than 3° C./s, to a second annealing soaking temperature TS2 between TS and Ac3 wherein $$TS=830-260*C-25*Mn+22*Si+40-Al$$

$$Ac3=901-262*C-29*Mn+31*Si-12*Cr-155*Nb+86*Al$$

wherein the elements contents are expressed in weight percentage.

during 10 seconds to 500 seconds to ensure an adequate re-crystallization and transformation to obtain a minimum of 50% Austenite microstructure. TS2 temperature is always less than or equal to TS1 temperature. The sheet is then cooled at a cooling rate CR2 which is greater than 20° C./s and preferably greater than 30° C./s and more preferably greater than 50° C./s to a temperature in the range Tstop which is between $Tc_{max}$ and $Tc_{min}$. These $Tc_{max}$ and $Tc_{min}$ are defined as follows:

$$Tc_{max}=565-601*(1-Exp(-0.868*C))-34*Mn-13*Si-10*Cr+13*Al-361*Nb$$

$$Tc_{min}=565-601*(1-Exp(-1.736*C))-34*Mn-13*Si-10*Cr+13*Al-361*Nb$$

wherein the elements content are expressed in weight percentage.

Thereafter, the cold rolled and annealed steel sheet is brought to a temperature range TOA which is from 380° C. to 580° C. and kept during 10 seconds to 500 seconds to ensure the formation of an adequate amount of Bainite as well as to temper the Martensite to impart the steel of the present invention with targeted mechanical properties. Afterwards, the cold rolled and annealed steel sheet is cooled to room temperature with a cooling rate of at least 1° C./s to form Martensite to obtain cold rolled and heat treated steel sheet. The preferred temperature range for TOA is from 380° C. to 500° C. and more preferably from 380° C. to 480° C.

The cold rolled heat treated steel sheet then may be optionally coated by any of the known industrial processes such as Electro-galvanization, JVD, PVD, Hot-dip(GI/GA) etc. The Electro-galvanization does not alter or modify any of the mechanical properties or microstructure of the cold rolled heat treated steel sheet as claimed. Electro-galvanization can be done by any conventional industrial process for instance by Electroplating.

The following tests, examples, figurative exemplification and tables which are presented herein are non-restricting in nature and must be considered for purposes of illustration only, and will display the advantageous features of the present invention.

Steel sheets made of steels with different compositions are enumerated and gathered in Table 1, where the steel sheets are produced according to process parameters as stipulated in Table 2, respectively. Thereafter the Table 3 gathers the microstructure of the steel sheets obtained during trails and table 4 gathers the result of evaluations of obtained properties.

Table 1 depicts the Steels with the compositions expressed in percentages by weight. The Steel compositions I1 to I5 for the manufacture of sheets according to the invention, this table also specifies the reference steel compositions which are designated in table by R1 to R4. Table 1 also serves as comparison tabulation between the inventive steel and reference steel. Table 1 also shows tabulation of Ac3 is defined for steel samples by the following equation:

$$Ac3=901-262*C-29*Mn+31*Si-12*Cr-155*Nb+86*Al$$

Table 1 is herein:

TABLE 1

| Steel Samples | C | Mn | Si | Al | Cr | Nb | S | P | Ca |
|---|---|---|---|---|---|---|---|---|---|
| A | 0.18 | 1.45 | 1.85 | 0.030 | 0.300 | 0.061 | 0.0010 | 0.011 | 0.0007 |
| B | 0.22 | 1.45 | 1.85 | 0.027 | 0.300 | 0.062 | 0.0010 | 0.011 | 0.0006 |
| C | 0.21 | 2.10 | 1.47 | 0.027 | 0.346 | 0.001 | 0.0017 | 0.012 | 0.0007 |
| D | 0.21 | 2.22 | 1.44 | 0.040 | 0.212 | 0.002 | 0.0010 | 0.011 | 0.0018 |
| E | 0.20 | 1.82 | 1.63 | 0.027 | 0.302 | 0.001 | 0.0021 | 0.011 | 0.0008 |
| F | 0.20 | 1.82 | 1.61 | 0.025 | 0.301 | 0.026 | 0.0020 | 0.010 | 0.0008 |
| G | 0.20 | 1.82 | 1.63 | 0.023 | 0.304 | 0.053 | 0.0019 | 0.010 | 0.0008 |

| Steel Samples | N | Mo | Cu | Ni | V | B | Ti | TS | Ac3 |
|---|---|---|---|---|---|---|---|---|---|
| A | 0.0056 | 0.003 | 0.007 | 0.010 | 0.001 | 0.0004 | 0.0030 | 788 | 858 |
| B | 0.0070 | 0.003 | 0.007 | 0.010 | 0.001 | 0.0004 | 0.0030 | 780 | 849 |
| C | 0.0068 | 0.004 | 0.008 | 0.023 | 0.001 | 0.0005 | 0.0050 | 756 | 829 |
| D | 0.0060 | 0.002 | 0.009 | 0.025 | 0.004 | 0.0008 | 0.0027 | 754 | 828 |
| E | 0.0034 | 0.001 | 0.005 | 0.013 | 0.001 | 0.0007 | 0.004 | 769 | 845 |
| F | 0.0036 | 0.001 | 0.005 | 0.013 | 0.001 | 0.0007 | 0.004 | 769 | 841 |
| G | 0.0036 | 0.001 | 0.005 | 0.013 | 0.001 | 0.0007 | 0.004 | 770 | 837 |

Table 2 gathers the annealing process parameters implemented on Steels of Table 1. The Steel compositions 11 to 17 serving for the manufacture of sheets according to the invention, this table also specifies the reference steel which are designated in table by R1 to R5. Table 2 also shows tabulation of $Tc_{min}$ and $Tc_{max}$. These $Tc_{max}$ and $Tc_{min}$ are defined for the inventive steels and reference steels as follows:

$$Tc_{max}=565-601*(1-Exp(-0.868*C))-34*Mn-13*Si-10*Cr+13*Al-361*Nb$$

$$Tc_{min}=565-601*(1-Exp(-1.736*C))-34*Mn-13*Si-10*Cr+13*Al-361*Nb$$

Further, before performing the annealing treatment on the steels of invention as well as on the reference ones, All the Steels were cooled after hot rolling at an average cooling rate of 40° C./s The Hot rolled coils were then processed as claimed and thereafter cold rolled with a thickness reduction between 30 to 95%. The final cooling rate is above 1° C./s.

These cold rolled steel sheets of both inventive steel and reference steel were subjected to heat treatments as enumerated in Table 2 herein:

TABLE 2

| Steel Sample | Trials | Reheating T(° C.) | HR Finish T(° C.) | HR Coiling T(° C.) | CR reduction (%) | First Annealing HR1 (° C./s) | TS1 (° C.) | Soaking time (s) | CR1 (° C./s) | Holding temperature T(° C.) | Holding t(s) |
|---|---|---|---|---|---|---|---|---|---|---|---|
| I1 | A | 1250 | 915 | 554 | 49 | 6 | 830 | 120 | 70 | 400 | 200 |
| I2 | B | 1245 | 930 | 546 | 51 | 6 | 830 | 120 | 70 | 400 | 200 |
| I3 | C | 1240 | 920 | 446 | 49 | 8 | 820 | 330 | 70 | 400 | 370 |
| I4 | D | 1220 | 937 | 546 | 55 | 6 | 770 | 80 | 70 | XXX | XXX |
| I5 | E | 1239 | 910 | 545 | 53 | 6 | 830 | 120 | 70 | XXX | XXX |
| I6 | F | 1239 | 910 | 545 | 53 | 6 | 830 | 120 | 70 | XXX | XXX |
| I7 | G | 1239 | 910 | 545 | 53 | 6 | 810 | 120 | 70 | XXX | XXX |
| R1 | A | 1250 | 915 | 554 | 49 | — | — | — | — | — | — |
| R2 | B | 1245 | 930 | 546 | 51 | — | — | — | — | — | — |
| R3 | C | 1240 | 920 | 446 | 49 | — | — | — | — | — | — |
| R4 | C | 1240 | 920 | 446 | 49 | — | — | — | — | — | — |
| R5 | D | 1220 | 937 | 546 | 55 | — | — | — | — | — | — |

| Steel Sample | Trials | Second Annealing HR2 (° C./s) | TS2 (° C.) | soaking time(s) | CR2 (° C./s) | Tstop (° C.) | Heating rate to TOA (° C./s) | TOA(° C.) | Holding t (s) | Ac3 T(° C.) | TS(° C.) | $Tc_{max}$ T(° C.) | Tcmin T(° C.) |
|---|---|---|---|---|---|---|---|---|---|---|---|---|---|
| I1 | A | 6 | 800 | 100 | 70 | 270 | 20 | 400 | 200 | 858 | 788 | 379 | 263 |
| I2 | B | 6 | 820 | 100 | 70 | 300 | 20 | 400 | 200 | 849 | 722 | 364 | 239 |
| I3 | C | 6 | 790 | 100 | 70 | 310 | 10 | 400 | 200 | 829 | 756 | 371 | 247 |
| I4 | D | 6 | 770 | 80 | 70 | 290 | 20 | 400 | 200 | 828 | 754 | 370 | 247 |
| I5 | E | 6 | 810 | 100 | 70 | 290 | 20 | 400 | 200 | 845 | 769 | 383 | 263 |
| I6 | F | 6 | 790 | 100 | 70 | 290 | 20 | 400 | 200 | 841 | 769 | 375 | 255 |
| I7 | G | 6 | 810 | 100 | 70 | 290 | 20 | 400 | 200 | 837 | 770 | 365 | 245 |
| R1 | A | 6 | 800 | 100 | 70 | 270 | 20 | 400 | 200 | 858 | 788 | 379 | 263 |
| R2 | B | 6 | 800 | 100 | 70 | 270 | 20 | 400 | 200 | 849 | 722 | 364 | 239 |
| R3 | C | 6 | 790 | 100 | 70 | 310 | 10 | 400 | 200 | 829 | 756 | 371 | 247 |
| R4 | C | 8 | 820 | 330 | 70 | 400 | 10 | 400 | 370 | 829 | 756 | 371 | 247 |
| R5 | D | 6 | 770 | 80 | 70 | 290 | 20 | 400 | 200 | 828 | 754 | 370 | 247 |

I = according to the invention; R = reference; underlined values: not according to the invention.

Table 3 exemplifies the results of test conducted in accordance of standards on different microscopes such as Scanning Electron Microscope for determining microstructural composition of both the inventive steel and reference steel. Residual Austenite is measured by Magnetic saturation measurement as per the publication titled as Structure and Properties of Thermal-Mechanically Treated 304 Stainless Steel in Metallurgical transactions in June 1970, Volume 1. Ferrite, Bainite, Tempered martensite and Martensite are observed through Image analysis conducted from with Aphelion software and with the interrupted dilatometry test The results are stipulated herein:

TABLE 3

| Steel Sample | Bainite | Ferrite | Residual Austenite | Martensite | Tempered Martensite | Annealed Martensite |
|---|---|---|---|---|---|---|
| I1 | 45 | 25 | 15 | 12 | 0 | 3 |
| I2 | 42 | 25 | 16 | 11 | 0 | 6 |
| I3 | 51 | 7 | 19 | 8 | 4 | 11 |
| I4 | 14 | 46 | 17 | 8 | 7 | 8 |
| I5 | 33 | 16 | 14 | 9 | 17 | 11 |
| I6 | 40 | 19 | 17 | 5 | 9 | 10 |
| I7 | 30 | 29 | 13 | 8 | 13 | 7 |
| R1 | 15 | 60 | 14 | 8 | 3 | 0 |
| R2 | 18 | 58 | 13 | 11 | 0 | 0 |
| R3 | 20 | 28 | 18 | 24 | 10 | 0 |
| R4 | 71 | 7 | 11 | 11 | 0 | 0 |
| R5 | 7 | 48 | 12 | 21 | 12 | 0 |

I = according to the invention; R = reference; underlined values: not according to the invention.

Table 4 exemplifies the mechanical properties of both the inventive steel and reference steel. In order to determine the tensile strength, yield strength and total elongation, tensile tests are conducted in accordance of JIS 22241 standards published in 11th Edition on Oct. 20, 2020 titled as METALLIC MATERIALS—TENSILE TESTING—METHOD OF TEST AT ROOM TEMPERATURE Henceforth the outcome of the various mechanical tests conducted in accordance to the standards is tabulated:

TABLE 4

| Sample Steels | Tensile Strength (in MPa) | Yield Strength (in MPa) | Total Elongation (in %) |
|---|---|---|---|
| I1 | 1025 | 611 | 24.4 |
| I2 | 1029 | 599 | 23.7 |
| I3 | 997 | 479 | 24.1 |
| I4 | 1054 | 565 | 22.5 |
| I5 | 1015 | 599 | 23.1 |
| I6 | 1053 | 582 | 21.1 |
| I7 | 1047 | 524 | 22.1 |
| R1 | 948 | 492 | 21.6 |
| R2 | 947 | 582 | 23.3 |
| R3 | 996 | 470 | 18.3 |
| R4 | 1032 | 549 | 15.8 |
| R5 | 1114 | 524 | 15.2 |

I = according to the invention; R = reference; underlined values: not according to the invention.

What is claimed is:

1. A cold rolled and heat treated steel sheet having a composition comprising the following elements, expressed in percentage by weight:

0.1%≤Carbon≤0.5%
1%≤Manganese≤3.4%
0.5%≤Silicon≤2.5%
0.01%≤Aluminum≤1.5%
0.05%≤Chromium≤1%
0.001%≤Niobium≤0.1%
0%≤Sulfur≤0.003%
0.002%≤Phosphorus≤0.02%
0%≤Nitrogen≤0.01% and optionally comprising the following elements:

0%≤Molybdenum≤0.5%
0.001%≤Titanium≤0.1%
0.01%≤Copper≤2%
0.01%≤Nickel≤3%
0.0001%≤Calcium≤0.005%
0%≤Vanadium≤0.1%
0%≤Boron≤0.003%
0%≤Cerium≤0.1%
0%≤Magnesium≤0.010%
0%≤Zirconium≤0.010% a remainder of the composition being composed of iron and the unavoidable impurities, and a microstructure of the cold rolled and heat treated steel sheet including by area fraction, 10% to 60% Bainite, 5% to 50% Ferrite, 5% to 25% Residual Austenite, Martensite 2% to 20%, Tempered Martensite 0% to 25%, a balance of the microstructure being Annealed Martensite from 1% to 11%, wherein the cold rolled and heat treated steel sheet has a tensile strength greater than 960 MPa, a total elongation of 20% or more and a yield strength from 479 MPa to 611 MPa.

2. The cold rolled and heat treated steel sheet as recited in claim 1 wherein the composition includes, in percentage by weight, 0.8%≤Silicon≤2%.

3. The cold rolled and heat treated steel sheet as recited in claim 1 wherein the composition includes, in percentage by weight, 1.2%≤Manganese≤2.8%.

4. The cold rolled and heat treated steel sheet as recited in claim 1 wherein the composition includes, in percentage by weight, 0.01%≤Aluminum≤1%.

5. The cold rolled and heat treated steel sheet as recited in claim 1 wherein the composition includes, in percentage by weight, 0.001%≤Niobium≤0.09%.

6. The cold rolled and heat treated steel sheet as recited in claim 1 wherein the composition includes, in percentage by weight, 0.1%≤Chromium≤0.8%.

7. The cold rolled and heat treated steel sheet as recited in claim 1 wherein the microstructure contains, by area fraction, 12% to 55% of bainite.

8. The cold rolled and heat treated steel sheet as recited in claim 1 wherein the microstructure contains, by area fraction, 8% to 24% of Residual Austenite.

9. The cold rolled and heat treated steel sheet as recited in claim 1 wherein the composition includes, in percentage by weight, 1.45%≤Manganese≤3.4%.

10. The cold rolled and heat treated steel sheet as recited in claim 1 wherein the microstructure contains, by area fraction, 16% to 50% of Ferrite.

11. The cold rolled and heat treated steel sheet as recited in claim 1 having a yield strength/tensile strength ratio is 0.45 or greater.

* * * * *